US009254053B2

(12) United States Patent
Arzumanyan et al.

(10) Patent No.: US 9,254,053 B2
(45) Date of Patent: Feb. 9, 2016

(54) PROMOTIONAL COASTER

(71) Applicants: David Arzumanyan, Newton, MA (US); Chris Costa, Nashua, NH (US)

(72) Inventors: David Arzumanyan, Newton, MA (US); Chris Costa, Nashua, NH (US)

( * ) Notice: Subject to any disclaimer, the term of this patent is extended or adjusted under 35 U.S.C. 154(b) by 38 days.

(21) Appl. No.: 14/172,626

(22) Filed: Feb. 4, 2014

(65) Prior Publication Data

US 2015/0216344 A1 Aug. 6, 2015

(51) Int. Cl.

| | |
|---|---|
| ***A47G 29/00*** | (2006.01) |
| ***A47G 23/03*** | (2006.01) |
| ***G09F 23/08*** | (2006.01) |

(52) U.S. Cl.

CPC ..... *A47G 23/0306* (2013.01); *G09F 23/08* (2013.01)

(58) Field of Classification Search

USPC ..... 248/346.11, 346.3, 346.5, 346.01; 220/737

See application file for complete search history.

(56) References Cited

U.S. PATENT DOCUMENTS

| | | | | |
|---|---|---|---|---|
| 4,184,595 | A * | 1/1980 | Wackerman | 206/423 |
| 5,413,302 | A * | 5/1995 | Ferster | 248/346.11 |
| 5,657,868 | A * | 8/1997 | Taylor | 206/423 |
| 5,752,686 | A * | 5/1998 | Cooley | 248/311.2 |
| 6,439,388 | B1 * | 8/2002 | Lerner | 206/562 |
| 6,676,097 | B2 * | 1/2004 | Chu | 248/346.01 |
| 6,746,735 | B2 * | 6/2004 | Snedeker | 428/34.1 |
| 7,708,242 | B1 * | 5/2010 | Petrashune et al. | 248/150 |
| 2009/0101783 | A1 * | 4/2009 | Luoma | 248/346.11 |

* cited by examiner

*Primary Examiner* — Steven Marsh

(74) *Attorney, Agent, or Firm* — Bay State IP, LLC

(57) ABSTRACT

A three-dimensional coaster apparatus for use with a vessel or container, wherein the coaster apparatus includes a substantially square base, and a substantially circular element container within the square base, wherein a plurality of side flaps extend outwardly from the square base and are hingedly attached at a point tangential to the square base.

9 Claims, 3 Drawing Sheets

PROMOTIONAL COASTER

BACKGROUND OF THE INVENTION

1. Field of the Invention

The instant invention relates generally to a combination holder and coaster apparatus, and more particularly to a three-dimensional coaster apparatus that provides for vertical advertising space once assembled during use with the bottom portion of a vessel such as a cup, can, glass, or bottle which contain liquids.

2. Description of the Related Art

Before the advent of the cheap coater, saucers were commonly used to hold containers of liquid to protect against condensation damage, spills, and heat. Saucers were small plates made of various hard non-absorbent materials that were expensive, non-disposable, and cumbersome.

The first known production of a drink coaster was in the late $19^{th}$ century. The construction of a coaster has not changed much since its invention in the late $19^{th}$ century. It is still constructed out of the same materials, but plastics and other synthetic materials are now used as well. The shape has remained relatively constant, as coasters are often square, rectangular, or circular.

The advantages of using a coaster are clear. The coaster prevents a vessel from slipping, causing water or heat damage to a surface, can absorb spills, and help stabilize a vessel. Many products that exist are drink sleeves that wrap around the beverage vessel. While these prevent damage to surfaces from condensation and heat, they are often too bulky and cumbersome to use effectively in a social setting, and they do not allow the user to see the contents of the beverage. Additionally, the sleeve style coasters can absorb liquids on the sides resulting in an easily ripped or otherwise damaged area where the vessel is grasped, making the possibility of slippage or spilling greater.

SUMMARY OF THE INVENTION

The instant apparatus and system, as illustrated herein, is clearly not anticipated, rendered obvious, or even present in any of the prior art mechanisms, either alone or in any combination thereof. Thus the several embodiments of the instant apparatus are illustrated herein.

It is therefore an object of the instant invention to provide a three-dimensional coaster apparatus that is easy to assembly and creates a more engage experience for the user.

It is another object of the instant invention to provide for a coaster apparatus, that once assembled provides for vertical advertising and marketing space.

The purpose of the Promo Coaster is to use the interactive and unique functionality to engage the customer, which creates a more effective marketing product.

When a customer receives an ordinary coaster at a place of business, they either briefly glance at it or chances are they do not even acknowledge it at all because of the simple fact that it is so common and simply a disposable item. The Promo Coaster gives the customer something to focus on and discuss; and even if only for a brief amount of time, the customers are focused on Promo Coaster and its advertisement. Also it is very common for patrons to show nervous habits at a bar such as bending a straw, stirring their drink constantly, folding napkins, etc. However if you provide them with an object that gives them something to focus their nervous energy on, then they are once again being more engaged with our product and its advertisements.

The instant invention includes a piece of liquid absorbing material such as cardboard or paper, which has perforated and stamped folding lines along each of its sides. The sides can be folded inward and secured on each other forming a shallow cup structure in which the vessel would sit snuggly. The raised edges that form the shallow cup allow for further advertising space, unimpeded by the vessel, which could features words or pictures angled outward, unlike the traditional coasters which only allow advertisements to be placed on the top to a coaster and would be covered by the vessel. Additionally, the shallow cup allows for the vessel to be visible.

There has thus been outlined, rather broadly, the more important features of coaster apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. To the accomplishment of the foregoing and related ends, certain illustrative aspects are described herein and these aspects are indicative of the various ways in which the principles disclosed herein can be practiced and all aspects and equivalents thereof are intended to be within the scope of the claimed subject matter.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION OF THE SEVERAL EMBODIMENTS

The detailed description set forth below is intended as a description of presently preferred embodiments of the invention and does not represent the only forms in which the present invention may be construed and/or utilized. The description sets forth the functions and the sequence of the steps for producing the system and accompanying apparatus. However, it is to be understood that the same or equivalent functions and sequences may be accomplished by different embodiments also intended to be encompassed within the scope of the invention.

Figure 1:
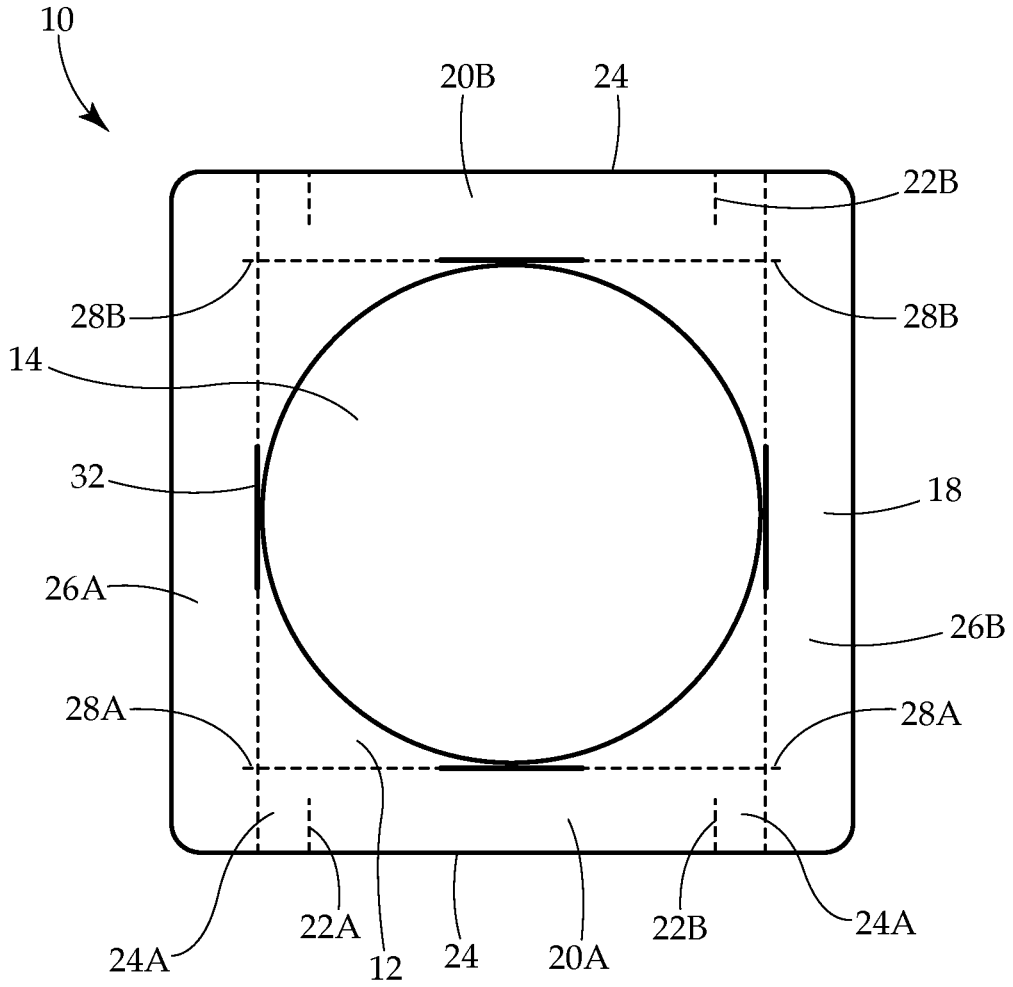
FIG. 1 is a perspective view of a coaster apparatus in a pre-assembled form.

Initially, FIG. 1 illustrates one embodiment of the instant invention 10, wherein the coaster apparatus 10 is shown in a pre-assembled form prior to use by an individual. In one embodiment, the coaster apparatus 10 comprises a substantially square base 12, wherein the substantially square base 12 further includes an outline of a substantially circular element 14 contained within the substantially square base 12. Preferably, the substantially circular element 14 is utilized as a guide for an individual user where to support a vessel or container 16 (see FIG. 2) during consumption. Furthermore, the coaster apparatus 10 includes a plurality of side flaps 18, wherein in the preferred embodiment, each side of the substantially square base 12 includes one side flap 18 extending outwardly therefrom. In one embodiment, each side flap 18 is hingedly attached at a point tangential to the corresponding side of the substantially square base 12.

In one embodiment, the coaster apparatus 10 comprises a first pair of opposing side flaps 20A and 20B, wherein each opposing side flap 20A and 20B in the first pair, include at least two indentations 22A and 22B located near opposite ends 24A and 24B and extending from a top 24 of the side flaps 20A and 20B. Additionally, the coaster apparatus 10 further comprises a second pair of opposing side flaps 26A and 26B, wherein each opposing side flap 26A and 26B in the second pair, include at least two indentations 28A and 28B located near opposite ends 30A and 30B and extending from a bottom 32 of the side flaps 26A and 26B. Preferably, in use, one indentation 22A extending from the top 24 of the side flap 20A in the first pair is received within the adjacent indentation 28A extending from the bottom 32 of the side flap 26A in the second pair. Therefore, once the adjacent indentations 22A and 28A are received with one another, this will cause the adjacent side flaps 20A and 26A to switch from a parallel to perpendicular orientation with respect to the substantially square base 12 (see FIG. 3).

Figure 2:
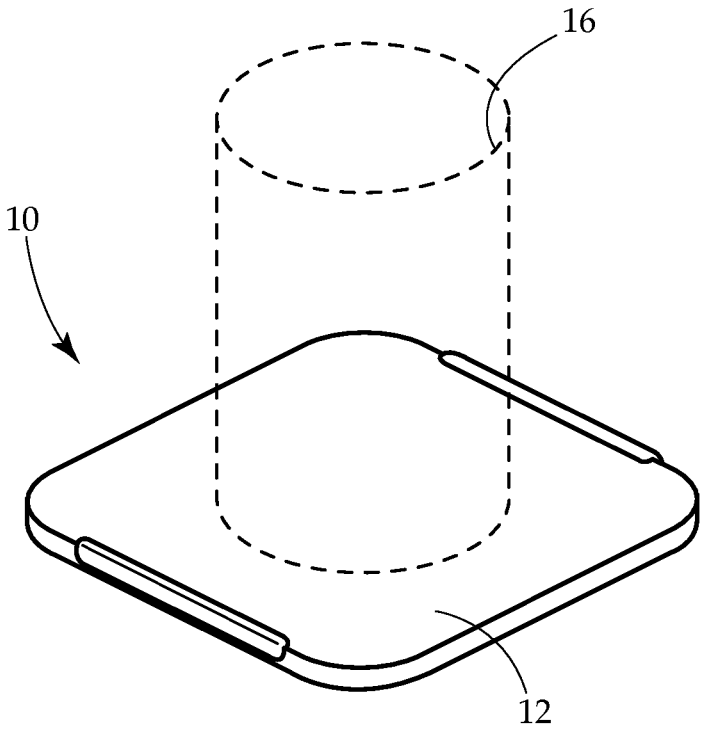
FIG. 2 is a perspective view of the coaster apparatus in a pre-assembled form, wherein a vessel or container is located within on a substantially square base.

FIG. 2 illustrates one embodiment of the coaster apparatus 10 again shown in a pre-assembled form, wherein the vessel or container 16 is located within the substantially circular element 14 within the substantially square base 12.

Figure 3:
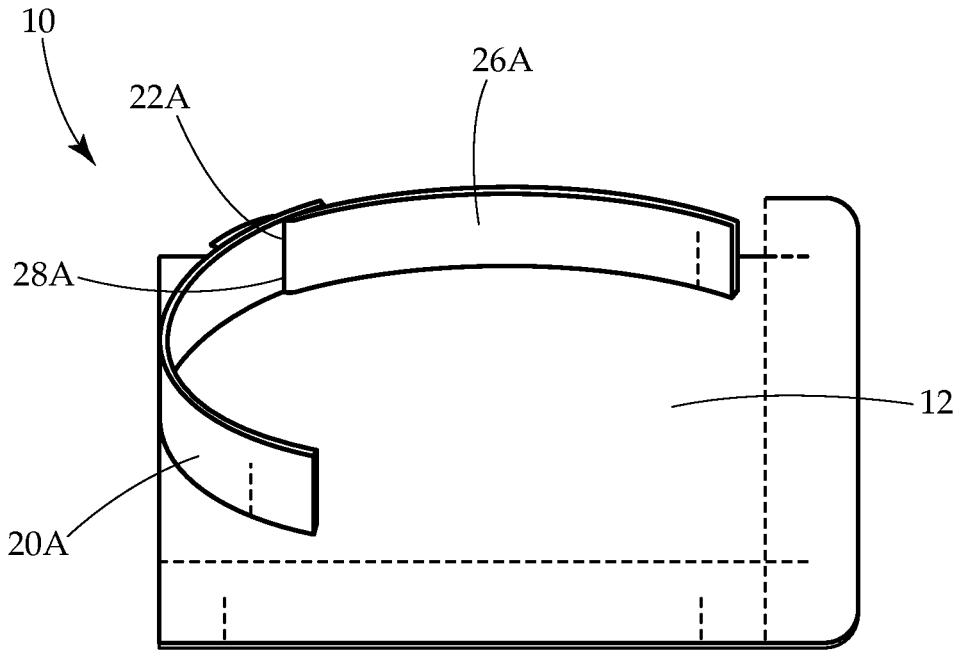
FIG. 3 is a perspective view of the coaster apparatus in a partially assembled form, wherein a pair of the side flaps are connected via a pair of adjacent grooves.

FIG. 3 illustrates a partially assembled coaster apparatus 10, wherein two of the side flaps 20A and 26A have been connected via their respective indentations 22A and 28A.

Figure 4:
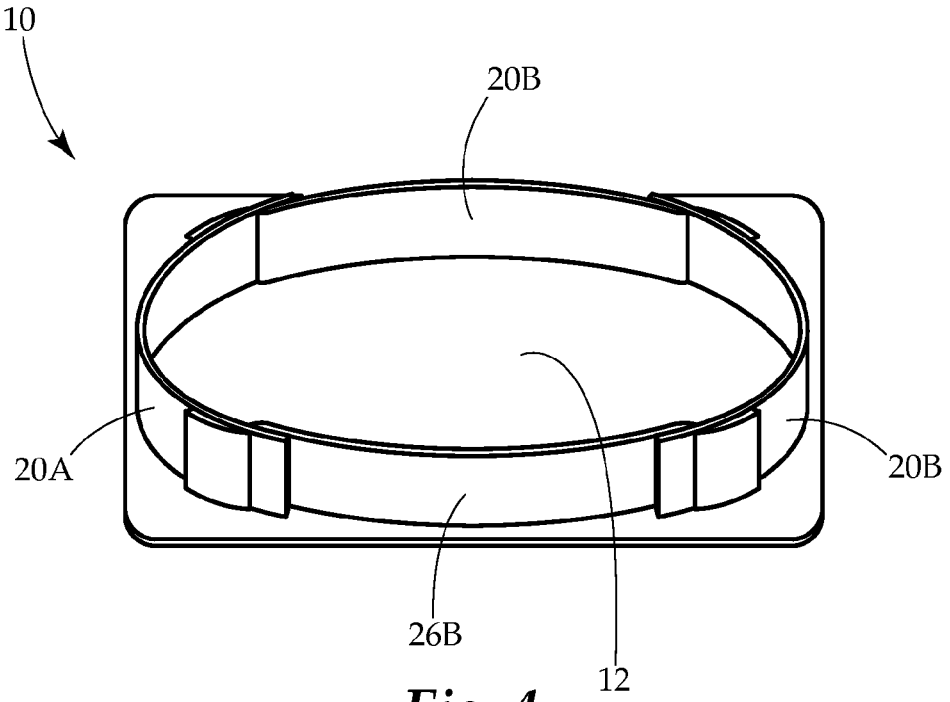
FIG. 4 is a perspective view of the fully assembled coaster apparatus.

FIG. 4 illustrates a fully assembled coaster apparatus 10, wherein a quantity of promotional and/or advertising content may be placed on an exterior surface 34 of each side flap 18.

Figure 5:
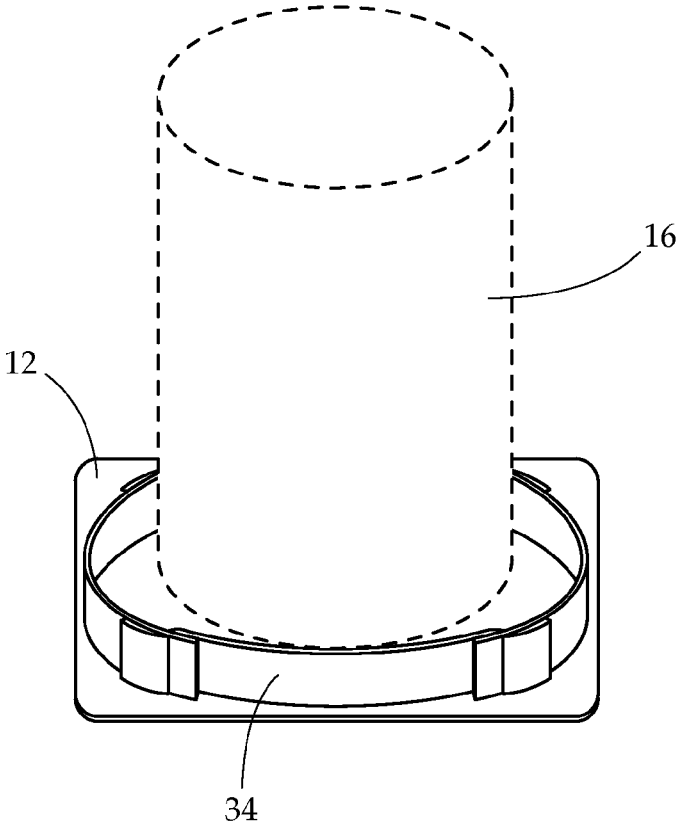
FIG. 5 is a perspective view of the fully assembled coaster apparatus located within the substantially square base and contained with the side flaps.

FIG. 5 illustrates a fully assembled coaster apparatus 10 including the vessel or container 16 located in the substantially circular element 14 and contained within the plurality of side flaps 18.

What is claimed is:

1. A coaster apparatus comprising:

a substantially square base;

a substantially circular element contained within the substantially square base; and a plurality of side flaps, wherein each side of the substantially square base includes one side flap extending outwardly therefrom;

wherein each side flap includes at least two indentations, wherein each indentation is received in a corresponding indentation located in an adjacent side flap.

2. The coaster apparatus of claim 1, wherein each side flap is hingedly attached at a point tangential to the corresponding side of the substantially square base.

3. The coaster apparatus of claim 1, wherein a quantity of promotional and/or advertising content is placed on an exterior surface of each side flap.

4. A promotional coaster comprising:

a substantially square base;

a first pair of opposing side flaps extending outwardly from the substantially square base, wherein the each opposing side flap in the first pair further comprises:

at least two indentations located near opposite ends and extending from a top of the side flaps;

a second pair of opposing side flaps extending outwardly from the substantially square base, wherein the each opposing side flap in the first pair further comprises:

at least two indentations located near opposite ends and extending from a bottom of the side flaps.

5. The promotional coaster of claim 4, wherein one indentation extending from the top of the side flap in the first pair is received within the adjacent indentation extending from the bottom of the side flap in the second pair.

6. The promotional coaster of claim 5, wherein once the adjacent indentations are received with one another, the adjacent side flaps will switch from a parallel to a perpendicular orientation with respect to the substantially square base.

7. The promotional coaster of claim 4, further comprising a substantially circular element contained within the substantially square base for receiving a container.

8. The promotional coaster of claim 4, wherein a quantity of promotional and/or advertising content is placed on an exterior surface of each side flap.

9. A three-dimensional coaster apparatus for assembly comprising:

a substantially square base;

a first pair of opposing side flaps extending outwardly from the substantially square base, wherein the each opposing side flap in the first pair further comprises:

at least two indentations located near opposite ends and extending from a top of the side flaps;

a second pair of opposing side flaps extending outwardly from the substantially square base, wherein the each opposing side flap in the second pair further comprises:

at least two indentations located near opposite ends and extending from a bottom of the side flaps;

wherein one indentation extending from the top of the side flap in the first pair is received within the adjacent indentation extending from the bottom of the side flap in the second pair and, wherein once the adjacent indentations are received with one another, the adjacent side flaps will switch from a parallel to a perpendicular orientation with respect to the substantially square base; and wherein a quantity of promotional and/or advertising content is placed on an exterior surface of each side flap.

* * * * *